United States Patent [19]

Berger et al.

[11] Patent Number: 4,981,028

[45] Date of Patent: Jan. 1, 1991

[54] METHOD FOR COLD-ROLLING SHEETS AND STRIPS

[75] Inventors: Bernd Berger, Kaarst; Gert Mücke, Hilden; Eberhart Neuschütz, Ratingen, all of Fed. Rep. of Germany

[73] Assignee: Betriebsforschungsinstitut VDeh, Dusseldorf, Fed. Rep. of Germany

[21] Appl. No.: 375,922

[22] Filed: Jul. 6, 1989

[30] Foreign Application Priority Data

Jul. 8, 1988 [DE] Fed. Rep. of Germany ..... 3823202

[51] Int. Cl.[5] ..... B21B 37/00

[52] U.S. Cl. ..... 72/8; 72/11; 72/237

[58] Field of Search ..... 72/8, 11, 243, 241

[56] References Cited

U.S. PATENT DOCUMENTS 3,694,636 9/1972 Smith, Jr. ..... 72/8
3,714,805 2/1973 Stone ..... 72/8
4,633,774 1/1987 Kuosa et al. ..... 72/8
4,753,093 1/1988 Siemon et al. ..... 72/11

*Primary Examiner*—Lowell A. Larson
*Assistant Examiner*—T. C. Schoeffler
*Attorney, Agent, or Firm*—Staas & Halsey

[57] ABSTRACT

In a method for cold-rolling sheets and strips, measured values which characterize the surface evenness, especially the tensile stress distribution, are formed on the delivery side of a rolling mill and, in dependence thereon, adjusting members of the rolling mill are actuated which form part of at least one regulating circuit for the surface evenness of the rolled sheets and strips. Incorrect adjustments and disruptions in the rolling process on the basis of the different time responses of the individual adjusting members are avoided by adjusting the adjusting members at speeds so matched to one another that during at least a portion of the adjusting time, the ratio of the adjustments of the participating adjusting members remains constant, and all adjusting members reach their desired values simultaneously.

6 Claims, 2 Drawing Sheets

METHOD FOR COLD-ROLLING SHEETS AND STRIPS

BACKGROUND OF THE INVENTION

The invention relates to a method for cold-rolling sheets and strips.

The surface evenness of cold-rolled sheets and strips can be distorted in different manners. Thus there may be, for example, strip curvature, long strip center short strip edges, long strip sides, edge waves, localized wave paths and short strip fibers and also the combined appearance of different faults in surface evenness, such as are shown in overview in FIG. 1 of the publication by E. Neuschutz in the book "Walzen von Flachprodukten" (Rolling of flat products), Informationsgesellschaft-Verlag, 1987, pages 7 to 26. The causes of such faults in surface evenness are unsuitable adjustment of the rollers, an unsuitable ground surface of the rollers, wear of the rollers, temperature differences over the barrel width of the rollers, differences in hardness in the strip and the embedding behavior of the strip at the strip edges.

By specific action on appropriate adjusting members of the rolling mill, the faults in surface evenness can be counteracted, it being possible to establish regulating circuits (control loops) with the surface evenness as a standard variable. For example, DE-OS 32 40 602.9 provides that, for regulating the tensile stress distribution during cold-rolling of strips on the basis of measurements of the tensile stress distribution, the adjusting members for the roller gap are positioned in such a manner that the differences between the tensile stress at the feed and the delivery sides of the rolling mill are maintained as constant as possible over the roller width and below a maximum value above which folding occurs during rolling. In that case, however, numerous faults in surface evenness still remain unconsidered which could be overcome by action on further adjusting members.

In total, in a modern six-roller mill, there are up to eight possible positions in order to ensure the surface evenness of the layer of the strip. For example, there may be included among the possible positions the pivoting of the rollers, the bending of the rollers by force at the roller barrel, an axial displacement of the rollers, for example, of the so-called intermediate rollers or by working rollers having different contours, the crossing of the rollers and influencing the roller cambering by cooling or heating on the one hand or by internal pressure of hollow rollers on the other hand. These adjusting members have a different time response as a result of which they are able to achieve their preset values in different times. For example, the deflection of the rollers can be carried out virtually without inertia so that there is no speed dependence, whereas an axial displacement of working rollers or of back-up rollers is speed-dependent because it cannot be carried out on stationary rollers. Thus, deviations which are no longer adjustable may occur with corresponding distortions.

SUMMARY OF THE INVENTION

The problem underlying the invention is to reduce incorrect adjustments and disruptions in the rolling process owing to different time responses of the adjusting members of the rolling mill.

According to the present invention, there is provided a method for cold-rolling sheets and strips wherein measured values which characterize surface evenness, especially the tensile stress distribution, are established on the delivery side of a rolling mill and, in dependence thereon, adjusting members of the rolling mill are actuated which form part of at least one regulating circuit for the surface evenness of the rolled sheets and strips, characterised in that the adjusting members of the regulating circuit(s) are adjusted at such relative speeds that, during at least a part of the adjusting time, the ratio of the adjustments of the participating adjusting members remains constant, with the proviso that all adjusting members reach their desired values simultaneously.

Thus, the adjusting members are adjusted at speeds matched to one another, in which at least partially proportional ways of adjustment result in the adjusting members reaching their preset values simultaneously.

In an advantageous design of the invention, minimization of the desired/actual deviation is carried out using the error squared method.

The result can be further improved by the use of weighting factors, as between the strip center and the strip edge, during the action on the adjusting members.

As a result, the adjusting members are thus adjusted in their combination with the proviso that the ratio of the adjustment ways remains constant even during the adjustment The function is thus minimized:

$$F = \sum_{i=1}^{N} [g_i(\Delta\delta_i - P_1(X_i) * V_1 - P_2(X_i) * V_2 \ldots)]^2$$

in which $X_i$: coordinates in direction of strip width $\Delta\delta_i$: desired/actual deviation of the stress distribution at the place $X_i$ $V_1$, $V_2$: adjustment of the adjusting members, 1, 2...

$P_1$, $P_2$: influencing factors of the adjusting members 1,2 etc. at the place $X_i$ $g_i$: weighting factor of the desired/actual deviation at the place $X_i$.

Using the weighting factor $g_i$, it is possible to evaluate the desired/actual deviations differently over the strip width. For example, the deviations at the strip edges can be evaluated as higher than the deviations in the central region of the strip.

The influencing functions $P_1(X_i)$, $P_2(X_i)$, ... of the adjusting members can be any desired functions.

By minimizing the function F, the unknown adjustments $V_1$, $V_2$, ... are obtained.

In order to ensure that the ratio of the calculated adjustment amounts $V_1$, $V_2$, ... remains constant, it is necessary to check whether, during the adjustment, the adjustment limits of individual adjusting members are exceeded or reached. For this purpose, the ratio of the possible and calculated adjustment is determined for all adjusting members. The calculated adjustments are then multiplied by the smallest detected ratio, as will be described in detail below.

The resulting adjustment amounts are so carried out that the ratio of the calculated adjustments $V_1$, $V_2$ ...remains constant even during the adjustment. In this manner, critical stress distributions in the strip and disruptions of the rolling process are avoided.

The influencing factors $P_1$, $P_2$, ... are in principle familiar to the person skilled in the art. The operations of the adjusting members occur in dependence on each manner of adjustment. Since the structures are different from mill to mill, it is necessary to determine these actions experimentally by investigating them individually and empirically. Once such an operation function has been determined, it can be present in order function has been determined, it can be preset in order to adopt a preset position in a computer.

The invention as described hitherto results in the slowest adjusting member determining the time in which the remaining adjusting members have to fulfill their functions. As a result, the ratio of the calculated adjustments remains equal even during the adjustment.

The adjustment ranges associated with each adjusting member can be defined especially in path units. If the calculated adjustment is added to the actual position of an adjusting member, this may result in a desired position being reached which lies outside the adjustment range. In contrast, the possible adjustment extends only from the actual position to the limit of the range of the adjusting member. According to the invention, therefore, only the ratio of the possible adjusting value to the calculated adjustment value is formed for all adjusting members. The remaining ratios of the other adjusting members, including that of the adjusting member which has the smallest path, are multiplied by the smallest ratio. This ensures that the ratio of the calculated adjustment paths between the individual adjusting members is maintained even when an individual adjusting member has reached its range limit.

For the procedure described hitherto, the slowest adjusting member is decisive, so that relatively long adjusting times are necessary in order to achieve a result. The dead times would be correspondingly extended. In order to reduce these in their turn, a modification of the invention according to claim 5 is used. According to that claim, the minimization can be carried out in two steps, the first step including the faster adjusting members. On the basis of these preset values, first the adjustments are calculated which can be travelled by the rapid adjusting members taking into account the restrictions. The result of this calculation is then decisive in order to carry out a further calculation with the slower members. The slow members are thus left out of consideration during the first calculation. For the calculation of the slower adjusting members, a numerical deviation is preset which does not agree with the measured deviation but with that deviation which has resulted on the basis of the calculation with the most rapid adjusting members. In that manner, the action of the rapid adjusting members has already been considered when the slow adjusting members are calculated.

The above-mentioned embodiment of the invention relates therefore not to the total adjustment time but only to a part thereof, as is permissible according to the basic principle of the invention. The advantage lies in the fact that it is possible to operate already with the rapid adjusting members in order to overcome disruptions in the surface evenness when possible. The next portion of the adjustment path of the more rapid members is, meanwhile, travelled at a different speed which results by extending the combination to the slower adjusting members in the proposed manner. In this manner, according to the embodiment of the invention, all adjusting members travel their adjustment paths in a corresponding time. The proposed minimization in this case takes place in groups, rapid and slow adjusting members forming different groups.

BRIEF DESCRIPTION OF THE DRAWINGS

For further clarification of the invention reference is made to the drawings.

DESCRIPTION OF THE PREFERRED EMBODIMENTS

Figure 1:
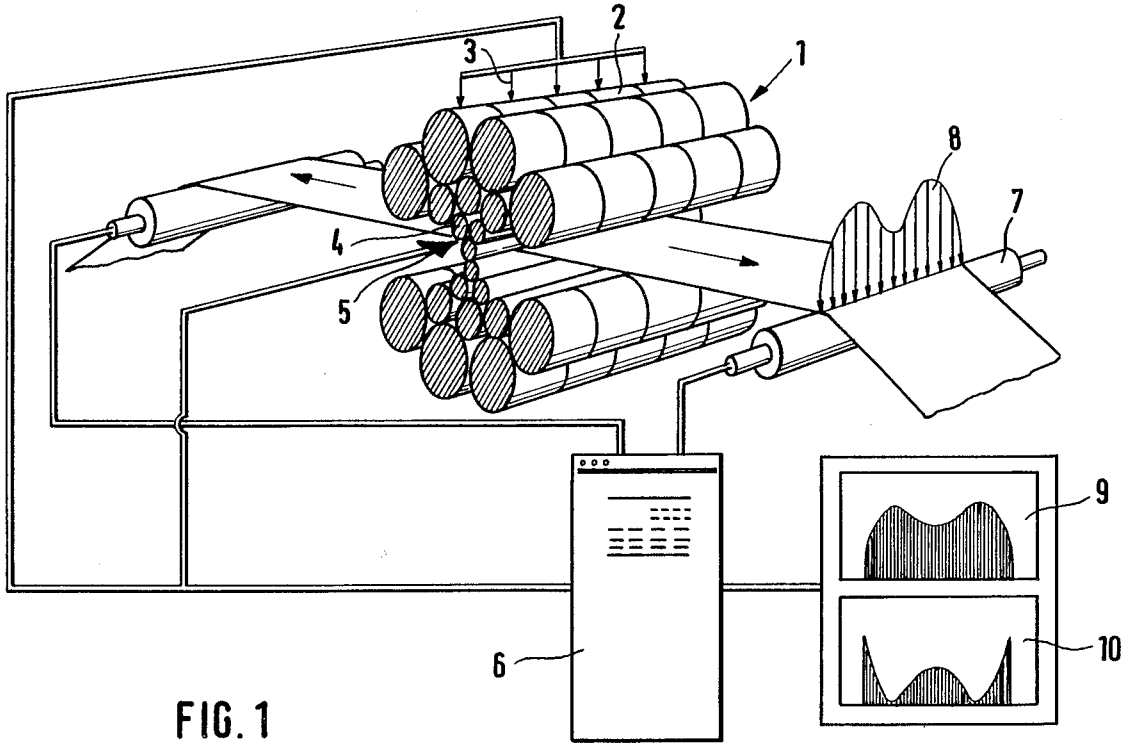
FIG. 1 shows a rolling mill having a regulating circuit of the type to which the invention relates.

In the regulating circuit to be formed according to the invention, a reversing 20-roller mill is, according to FIG. 1, so regulated with a relatively large number of adjusting members of the type described that a strip having limited length differences $\Delta L/L$ can be rolled. It can be seen that there are provided on the back-up roller 2 axially spaced adjusting members 3 and that an adjusting member 5 is provided acting on the axial position of cone rollers 4. A regulator 6 determines, on the basis of the pressure values 8 measured by the deflection measuring roller 7, the preset values with which the adjusting member 5 on the one hand and the adjusting members 3 on the other hand are to be driven in order to exclude the existing faults both in the center of the strip and at the edges of the strip. In practice, there may be substantially more sensors on the one hand and adjusting members on the other, as has been described. The result of the measuring permits a differentiated evaluation so that strip distortions can be shown on the screens 9 and 10.

Figure 2:
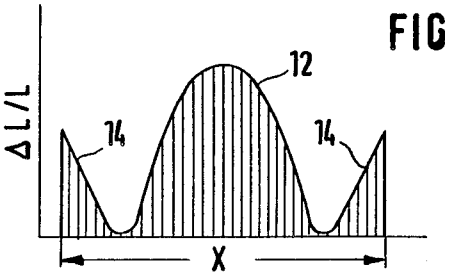
FIG. 2 shows the longitudinal distribution over the width x in a so-called long strip center and in the case of so-called edge waves.
Figure 3:
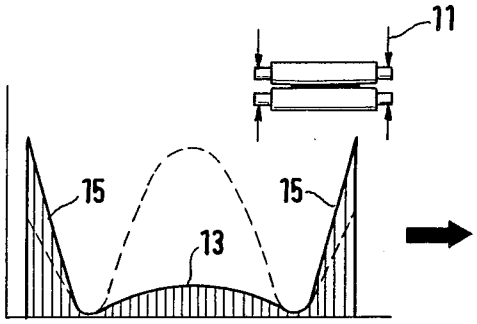
FIG. 3 shows the single action of the adjusting member "roller deflection"

The invention permits the long strip center and edge waves present according to FIG. 2 to be remedied in the proposed manner. For clarification, FIG. 3 shows firstly what result an adjusting member 11 acting only by altering the roller curvature would have. It can be seen that the long strip center 12 of FIG. 2 can be reduced to an acceptable deviation according to the curve 13 in FIG. 3. In conjunction therewith, however, the edge waves 14, which in FIG. 2 appear clearly at the edge not only have not been removed but are even more pronounced, as the edge curves 15 in FIG. 3 show.

Figure 5:
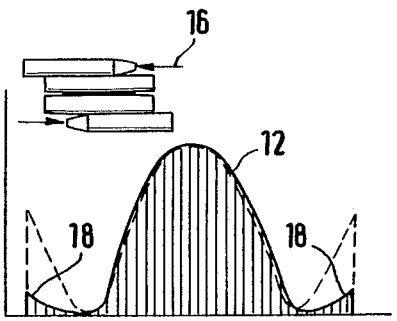
FIG. 5 shows the single action of the adjusting member "axial displacement" of the rollers.

If now, according to FIG. 5, the axially acting adjusting members 16 are activated by displacing the cone rollers axially, then the edge waves 14 in FIG. 2 can be extensively removed in such a manner that only tolerable deviations 18 according to FIG. 5 remain. In that case, however, the pronounced strip center 12 of FIG. 2 remains, appearing in FIG. 5 in virtually the same manner.

Figure 4:
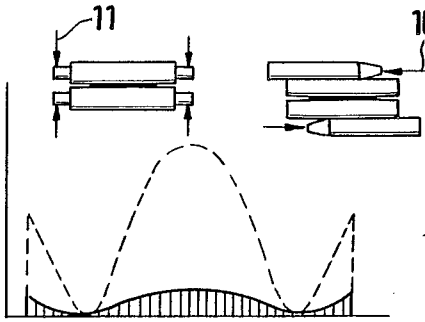
FIG. 4 shows the joint action of the adjusting members "roller deflection" and "axial displacement" of the rollers.

According to FIG. 4, the invention teaches the simultaneous operation of the adjusting members 11 and 16. If this were to be carried out in the customary manner there would be a danger of obtaining more or less results of the type as shown in FIG. 3 or FIG. 5 This is caused by the fact that each adjusting member has its own speed in which it assumes its preset desired value.

The invention comes into play at this point by taking into account their speeds during the adjustment period. The speeds can be measured previously without difficulty under operating conditions so that there is a particular speed value for each adjusting member. If it is assumed that the adjustment speed measured in this manner is twice as high for adjusting member 11 as for adjusting member 16, then normally the adjusting member 11 would travel its preset value in half the time in which the adjusting member 16 would reach its preset position. As a result, it would not be possible to remove several strip distortions simultaneously. According to the invention, the drive for the more rapid adjusting member 11 is throttled so that it would achieve its adjustment value under the operating conditions at the same time at which the slower adjusting member 16 would assume this position. It is a question of throttling the speed of this one adjusting member in line with a slower adjusting member.

In practice, it is possible to test incrementally whether the adjusting values reach their individual positions in the manner foreseen in order, as necessary, to block a drive which is too rapid. Even in the case of relatively rapid adjusting members, however, the speed can be reduced by permanent attenuation by, for example, driving an electrically driven adjusting member with a relatively low current intensity.

We claim:

1. A method for cold-rolling sheets and strips comprising the steps of:

establishing measured values which characterize surface evenness, especially the tensile stress distribution, on a delivery side of a rolling mill;

in dependence thereon, actuating adjusting members of the rolling mill which form part of at least one regulating circuit for the surface evenness of the rolled sheets and strips; and adjusting the adjusting members of the at least one regulating circuit at such relative speeds that, during at least a part of an adjusting time, the ratio of the adjustments of the adjusting members being adjusted remains constant, wherein for each adjusting member the ratio of the possible adjustment to a preset adjustment is established;

wherein the preset adjustments are then multiplied by the smallest of the ratios; and wherein all adjusting members reach their desired values simultaneously.

2. The method according to claim 1, wherein the adjustment to be preset for the adjusting members are formed on the basis of a minimization of the sum of the squares of the differences which result from the desired-/actual deviations, and the sum of the actions of the adjusting members.

3. The method according to claim 2, wherein the difference between the desired/actual deviations and the sum of the action of the adjusting members, seen over the width of the strip, are weighted so that the weighting factors are selected differently between the strip center and the strip edge.

4. A method according to claim 1 wherein, for determining the adjustments, first the adjusting members having the greater adjustment speeds are considered in one group in such a manner that their adjustment is initiated first, while, taking into consideration these adjustments, the adjustments for the adjusting members having the lesser speeds are determined, and then all the adjusting members are subject to a common adjustment while maintaining the constancy of their ways of adjustment.

5. A method according to claim 2, wherein, for determining the adjustments, first the adjusting members having the greater adjustment speeds are considered in one group in such a manner that their adjustment is initiated first, while, taking into consideration these adjustments, the adjustments for the adjusting members having the lesser speeds are determined, and then all the adjusting members are subject to a common adjustment while maintaining the constancy of their ways of adjustment.

6. A method according to claim 3, wherein, for determining the adjustments, first the adjusting members having the greater adjustment speeds are considered in one group in such a manner that their adjustment is initiated first, while, taking into consideration these adjustments, the adjustments for the adjusting members having the lesser speeds are determined, and then all the adjusting members are subject to a common adjustment while maintaining the constancy of their ways of adjustment.

* * * * *